US009796070B2

(12) United States Patent
Sun

(10) Patent No.: US 9,796,070 B2
(45) Date of Patent: Oct. 24, 2017

(54) MULTI-FUNCTION HANDLE

(71) Applicant: SHANGHAI EASY-USE TOOLS ENTERPRISE CO., LTD., Shanghai (CN)

(72) Inventor: Shiyu Sun, Shanghai (CN)

(73) Assignee: SHANGHAI EASY-USE TOOLS ENTERPRISE CO., LTD., Shanghai (CN)

( * ) Notice: Subject to any disclaimer, the term of this patent is extended or adjusted under 35 U.S.C. 154(b) by 280 days.

(21) Appl. No.: 14/443,925

(22) PCT Filed: May 14, 2014

(86) PCT No.: PCT/CN2014/077424

§ 371 (c)(1),
(2) Date: May 19, 2015

(87) PCT Pub. No.: WO2015/135250

PCT Pub. Date: Sep. 17, 2015

(65) Prior Publication Data

US 2016/0243684 A1 Aug. 25, 2016

(30) Foreign Application Priority Data

Mar. 14, 2014 (CN) ..... 2014 1 00962783

(51) Int. Cl.

| | |
|---|---|
| ***B25B 23/00*** | (2006.01) |
| ***B25B 15/04*** | (2006.01) |
| ***B25G 1/08*** | (2006.01) |
| ***B25G 3/18*** | (2006.01) |
| ***B25B 15/02*** | (2006.01) |

(52) U.S. Cl.

CPC ..... *B25B 23/0021* (2013.01); *B25B 15/02* (2013.01); *B25B 15/04* (2013.01); *B25B 23/0042* (2013.01); *B25G 1/085* (2013.01); *B25G 3/18* (2013.01)

(58) Field of Classification Search

CPC . B25B 23/0021; B25B 23/0042; B25B 23/16; B25B 15/02; B25B 15/04; B25G 1/08; B25G 1/085

USPC ..... 81/177.4

See application file for complete search history.

(56) References Cited

U.S. PATENT DOCUMENTS 4,449,559 A * 5/1984 Martinmaas ..... B25G 1/085 81/177.4
7,305,908 B2 * 12/2007 Chi ..... B25G 1/085 81/177.4

(Continued)

FOREIGN PATENT DOCUMENTS

| | | |
|---|---|---|
| CN | 201086266 Y | 7/2008 |
| CN | 201186419 Y | 1/2009 |
| DE | 102004032341 A1 | 12/2005 |

*Primary Examiner* — David B Thomas

(74) *Attorney, Agent, or Firm* — Muncy, Geissler, Olds & Lowe, P.C.

(57) ABSTRACT

A multi-function handle includes a connecting rod and a handle. The handle has an accommodation cavity therein. One end of the connecting rod is secured in the accommodation cavity from either of two ends of the handle, enabling the length of the connecting rod exposed out of the handle to be different. The present invention has a simple structure and an adjustable length, and is convenient for use.

5 Claims, 3 Drawing Sheets

(56) References Cited

U.S. PATENT DOCUMENTS

| | | | | |
|---|---|---|---|---|
| 7,523,689 | B2 * | 4/2009 | Lin | B25B 13/461 81/177.2 |
| 8,136,430 | B2 * | 3/2012 | Hu | B25B 15/02 81/177.2 |
| 8,297,156 | B2 * | 10/2012 | Chiu | B25B 23/0028 81/177.2 |
| 8,307,743 | B2 * | 11/2012 | Hsu | B25B 15/02 81/177.2 |
| 9,102,050 | B2 * | 8/2015 | Su | B25G 1/04 |
| 9,186,781 | B2 * | 11/2015 | Wang | B25B 13/463 |
| 2012/0285299 | A1 * | 11/2012 | Chen | B25B 15/001 81/177.2 |
| 2014/0060263 | A1 | 3/2014 | Lin | |
| 2014/0290449 | A1 * | 10/2014 | Hsieh | B25B 23/0042 81/491 |

* cited by examiner

MULTI-FUNCTION HANDLE

BACKGROUND OF THE INVENTION

1. Field of the Invention

The present invention relates to a handle, and more particularly to a multi-function handle.

2. Description of the Prior Art

A tool handle is a handle in cooperation with a tool bit to meet the demand for a variety of tools in different specifications with a handle only to simplify the structure and to save the storage space.

However, the length of a conventional tool handle is not adjustable. When in use, a longer handle is required for unscrewing internal screws, but in some cases, a shorter handle may be required. The conventional handle cannot meet such a demand. Accordingly, the inventor of the present invention has devoted himself based on his many years of practical experiences to solve these problems.

SUMMARY OF THE INVENTION

The primary object of the present invention is to provide a multi-function handle to solve the problem that the length of the conventional tool handle cannot be adjusted.

In order to achieve the aforesaid object, the multi-function handle of the present invention comprises a connecting rod and a handle. The handle has an accommodation cavity therein. One end of the connecting rod is secured in the accommodation cavity from either of two ends of the handle, enabling the length of the connecting rod exposed out of the handle to be different.

Preferably, the multi-function handle further comprises a fixing sleeve disposed in the accommodation cavity. The fixing sleeve mates with the connecting rod.

Preferably, one end of the connecting rod is provided with an engaging recess, a ball in the engaging recess, and a spring between the ball and the engaging recess.

Preferably, another end of the connecting rod is connected with a sleeve, and the sleeve is adapted to secure a tool bit.

Preferably, the handle is further provided with a plurality of fixing cavities therein for accommodating tool bits.

Preferably, the connecting rod is provided with a fixing groove able to be secured to a stop ring provided on the handle.

Preferably, the connecting rod comprises a connecting portion and a fixing portion. The fixing portion is to mate with the fixing sleeve. The fixing portion is fitted inside the fixing sleeve.

Preferably, the connecting portion has a diameter greater than that of the fixing portion. After the fixing portion is fitted inside the fixing sleeve, the junction of the connecting portion and the fixing portion is engaged on the fixing sleeve.

Preferably, the fixing portion is provided with an engaging recess, a ball is provided in the engaging recess, and a spring is provided between the ball and the engaging recess.

Preferably, a ratchet is provided between the fixing sleeve and the accommodation cavity.

The present invention has a simple structure and an adjustable length, and is convenient for use.

DETAILED DESCRIPTION OF THE PREFERRED EMBODIMENTS

Embodiments of the present invention will now be described, by way of example only, with reference to the accompanying drawings.

Figure 1:
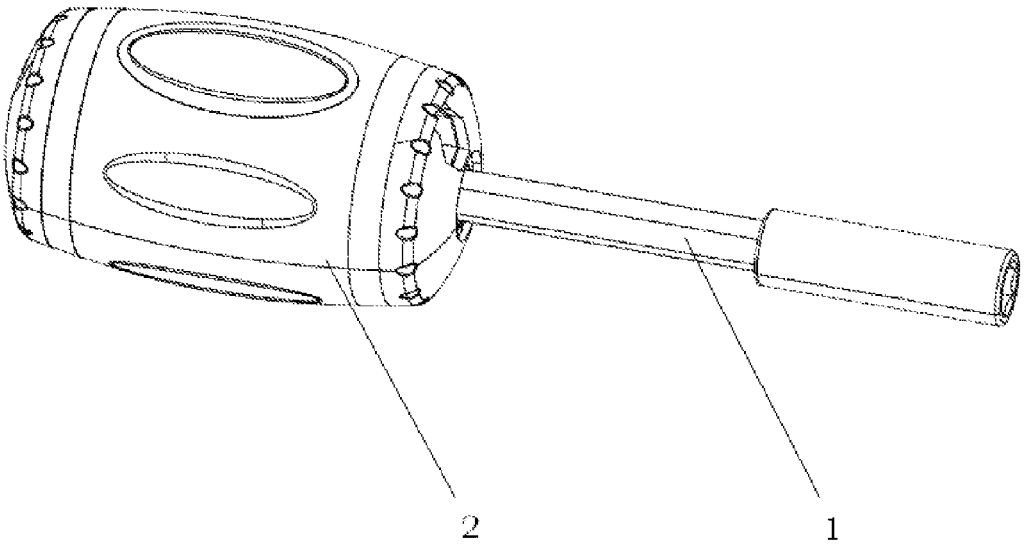
FIG. 1 is a schematic view according to a first embodiment of the present invention.
Figure 2:
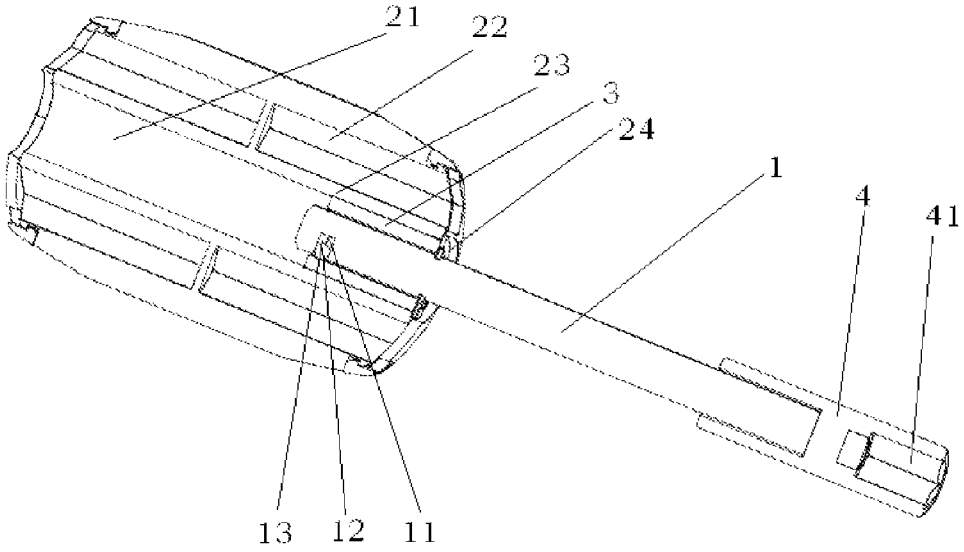
FIG. 2 is a sectional view according to the first embodiment of the present invention.

As shown in FIG. 1 and FIG. 2, the present invention discloses a multi-function handle. The multi-function handle comprises a connecting rod 1 and a handle 2. The handle 2 has an accommodation cavity 21 therein. One end of the connecting rod 1 can be secured in the accommodation cavity 21 from either of two ends of the handle 2, such that the length of the connecting rod 1 exposed out of the handle 2 can be different.

The present invention is further provided with a plurality of fixing cavities 22 inside the handle 2 for accommodating tool bits therein.

The present invention further comprises a fixing sleeve 3 disposed in the accommodation cavity 21. The fixing sleeve 3 is adapted to connect the connecting rod 1. A fixing trough 23 is formed inside the accommodation cavity 21. The fixing sleeve 3 is retained in the fixing trough 23, preventing the fixing sleeve 3 from sliding in the accommodation cavity 21.

One end of the connecting rod 1 of the present invention is provided with an engaging recess 11. A ball 12 is provided in the engaging recess 11. A spring 13 is provided between the ball 12 and the engaging recess 11.

Another end of the connecting rod 1 of the present invention is connected with a sleeve 4. The sleeve 4 is provided with a cavity 41 therein. The cavity 41 is adapted to secure a tool bit.

The connecting rod 1 of the present invention can be designed in various configurations. The front end of the connecting rod 1 can be formed with a fixing portion to accommodate a tool bit.

The connecting rod 1 of the present invention is provided with a fixing groove (not shown in the drawings) which can be secured to a stop ring 24 disposed on the handle 2.

When this embodiment is used, one end of the connecting rod 1 is inserted into the fixing sleeve 3. Because one end of the connecting rod 1 is provided with the spring 13 and the ball 12, the connecting rod 1 can bring the ball 12 to move and simultaneously compress the spring 13. The ball 12 is slid to the inside of the fixing sleeve 3. At this time, the length of the connecting rod 1 exposed out of the handle 2 is longer. The connecting rod 1 is provided with the fixing groove to mate with the stop ring 24, preventing it from wobbling. When the connecting rod 1 is placed into the fixing sleeve 3, the stop ring 24 abuts against the handle 2, preventing it from sliding to the inside of the handle 2. When the user wants to shorten the length of the connecting rod 1, the connecting rod 1 is taken out of the handle 2 and inserted into another end of the handle 2 while one end of the connecting rod 1 is inserted into the fixing sleeve 3. Because the fixing sleeve 3 is disposed at one end of the handle 2, the length of the connecting rod 1 exposed out of the handle 2 is shorter when the connecting rod 1 is inserted from another end of the handle 2.

In this embodiment, the other end of the connecting rod 1 is provided with the sleeve 4. The sleeve 4 is adapted to secure a tool bit. The other bits not used can be stored in the fixing cavities 22 inside the handle 2.

Figure 3:
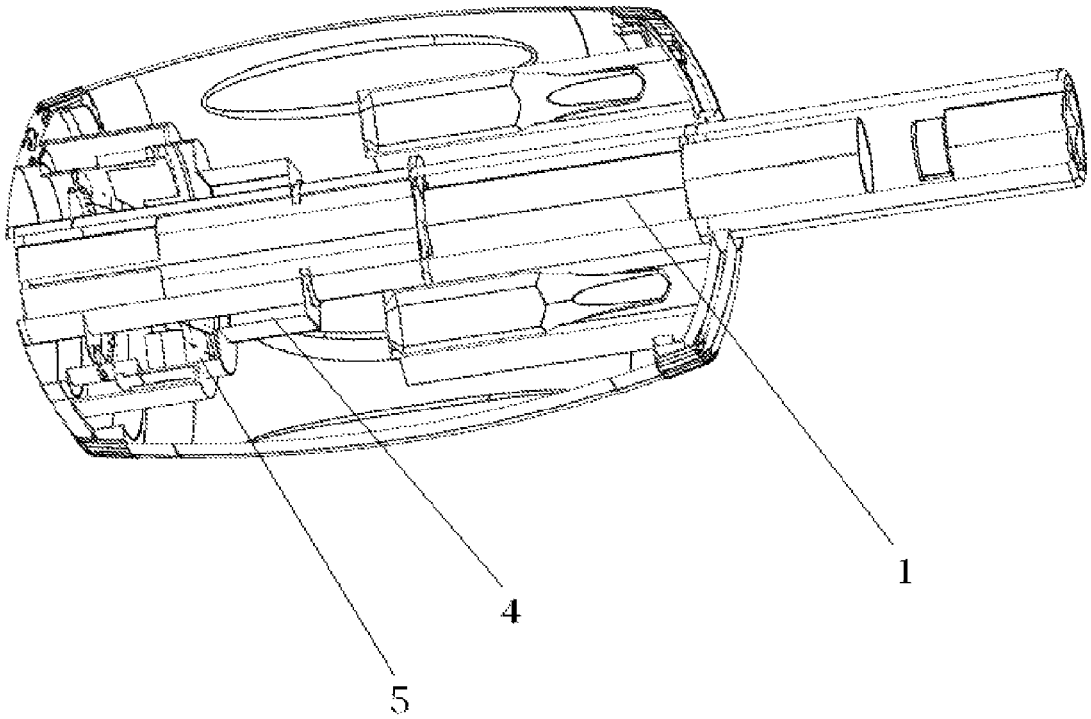
FIG. 3 is a schematic view according to a second embodiment of the present invention.

FIG. 3 is a schematic view according to a second embodiment of the present invention. The present invention further comprises a ratchet 5 secured to the handle 2. The connecting rod 1 can be engaged inside the ratchet 5. When the connecting rod 1 is moved downward, the connecting rod 1 is fitted in the ratchet 5. Through the ratchet 5, it is convenient for turning and labor-saving for use.

Figure 4:
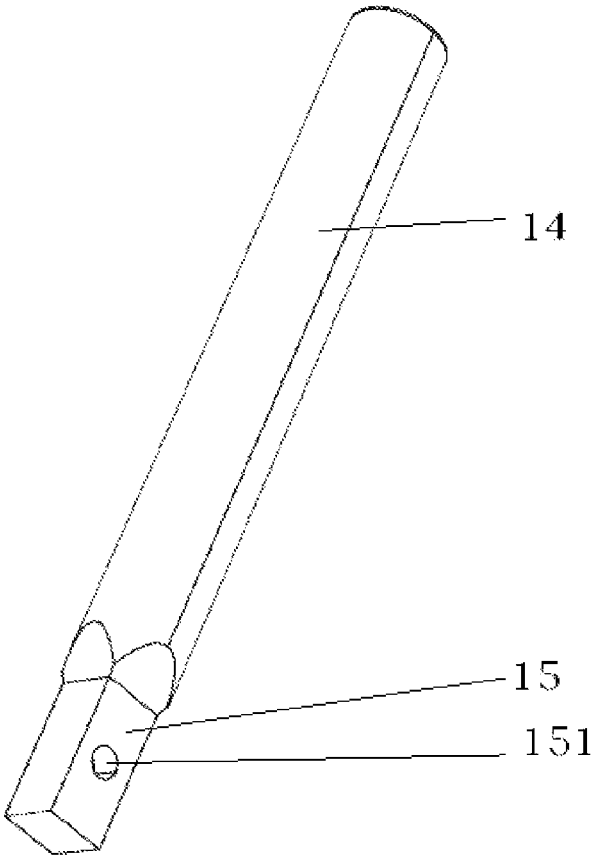
FIG. 4 is a schematic view according to a third embodiment of the present invention.

FIG. 4 is a schematic view according to a third embodiment of the present invention. As shown in the drawing, the connecting rod comprises a connecting portion 14 and a fixing portion 15. The fixing portion 15 is to mate with the fixing sleeve. The fixing portion 15 is fitted inside the fixing sleeve. The connecting portion 14 has a diameter greater than that of the fixing portion 15. After the fixing portion 15 is fitted inside the fixing sleeve, the junction of the connecting portion 14 and the fixing portion 15 is engaged on the fixing sleeve. The fixing portion 15 is provided with an engaging recess 151. A ball (not shown) is provided in the engaging recess 151. A spring (not shown) is provided between the ball and the engaging recess. Another end of the connecting rod is connected with a sleeve. The sleeve is adapted to secure different tool bits.

Figure 5:
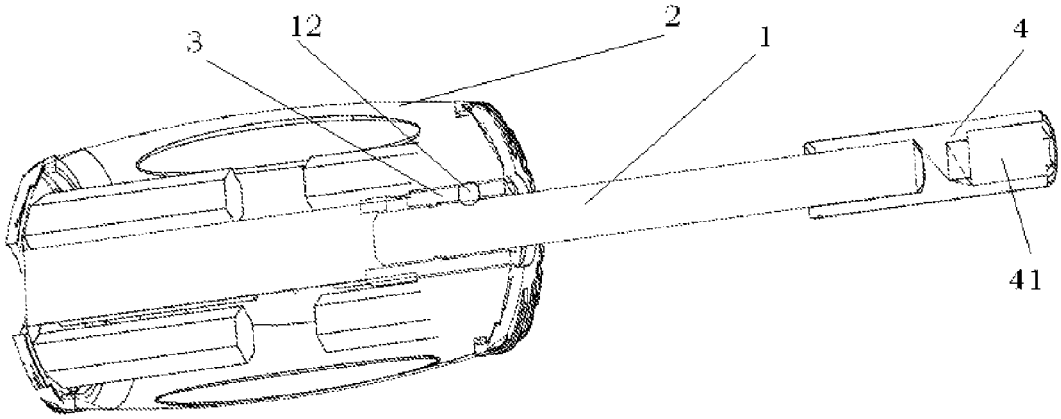
FIG. 5 is a schematic view according to a fourth embodiment of the present invention.

FIG. 5 is a schematic view according to a fourth embodiment of the present invention. As shown in the drawing, a multi-function handle comprises a connecting rod 1 and a handle 2. The handle has an accommodation cavity therein. One end of the connecting rod can be fixed in the accommodation cavity from either of two ends of the handle, such that the length of the connecting rod exposed out of the handle can be different. The present invention is further provided with a plurality of fixing cavities inside the handle for accommodating tool bits therein. The present invention further comprises a fixing sleeve 3 disposed inside the accommodation cavity. The fixing sleeve is adapted to connect the connecting rod. One end of the fixing sleeve of the present invention is provided with an engaging recess. A ball is provided in the engaging recess. A spring is provided between the ball and the engaging recess. Another end of the connecting rod of the present invention is connected with a sleeve 4. The sleeve is provided with a cavity 41 therein. The cavity is adapted to secure a tool bit.

In this embodiment, one end of the connecting rod is secured to the inside of the fixing sleeve through the ball and the spring and can be taken out conveniently.

When the present invention is used, the fixing portion of the connecting rod is inserted into the fixing sleeve. The junction of the fixing portion and the connecting portion is engaged on the fixing sleeve, preventing it from sliding into the fixing sleeve. At this time, the length of the connecting rod exposed out of the handle is longer. The connecting rod can be taken out of the fixing sleeve and inserted into another end of the handle while the fixing portion is inserted from another end of the fixing sleeve. The fixing portion is fitted into the fixing sleeve while the junction of the fixing portion and the connecting portion is engaged on the fixing sleeve, preventing it from sliding into the fixing sleeve. At this time, the length of the connecting rod exposed out of the handle is shorter.

The accommodation cavity of the present invention is a through hole formed at a central portion of the handle. One end of the connecting rod can be inserted and secured in the accommodation cavity from either of two ends of the handle, such that the length of the connecting rod exposed out of the handle can be different. Because the connecting rod is secured in the accommodation cavity and the connecting rod can be inserted from either of the two ends of the handle to be secured at one end of the handle in two different ways, the length of the connecting rod exposed out of the handle can be different for the user to use it conveniently.

The length of the tool handle of the present invention is adjustable for convenient use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function handle, comprising a connecting rod and a handle, the handle having an accommodation cavity therein, one end of the connecting rod being secured in the accommodation cavity from either of two ends of the handle, enabling the length of the connecting rod exposed out of the handle to be different, wherein the multi-function handle comprises a fixing sleeve disposed in the accommodation cavity, the fixing sleeve mating with the connecting rod, wherein the connecting rod comprises a connecting portion and a fixing portion, the fixing portion is to mate with the fixing sleeve, and the fixing portion is fitted inside the fixing sleeve, and wherein the connecting portion has a diameter greater than that of the fixing portion, wherein after the fixing portion is fitted inside the fixing sleeve, a junction of the connecting portion and the fixing portion is engaged on the fixing sleeve.

2. The multi-function handle as claimed in claim 1, wherein one end of the connecting rod is provided with an engaging recess, a ball is provided in the engaging recess, and a spring is provided between the ball and the engaging recess.

3. The multi-function handle as claimed in claim 1, wherein the fixing portion is provided with an engaging recess, a ball is provided in the engaging recess, and a spring is provided between the ball and the engaging recess.

4. The multi-function handle as claimed in any one of claim 1, a ratchet is provided between the fixing sleeve and the accommodation cavity.

5. A multi-function handle, comprising a connecting rod and a handle, the handle having an accommodation cavity therein, one end of the connecting rod being secured in the accommodation cavity from either of two ends of the handle, enabling the length of the connecting rod exposed out of the handle to be different, wherein another end of the connecting rod is connected with a sleeve, and the sleeve is adapted to secure a tool bit, wherein the handle is further provided with a plurality of fixing cavities therein for accommodating tool bits, and wherein the connecting rod is provided with a fixing groove able to be secured to a stop ring provided on the handle.

* * * * *